United States Patent [19]

L'Heureux

[11] Patent Number: 4,494,686

[45] Date of Patent: Jan. 22, 1985

[54] WIRE SETTING TOOL

[76] Inventor: Lee H. L'Heureux, Box 8644, c/o ARAMCO, Dhahran, Saudi Arabia

[21] Appl. No.: 495,939

[22] Filed: May 19, 1983

[51] Int. Cl.[3] ..... B25C 7/00

[52] U.S. Cl. ..... 227/147; 29/798

[58] Field of Search ..... 227/147; 29/278, 432, 29/798

[56] References Cited

U.S. PATENT DOCUMENTS

| | | | |
|---|---|---|---|
| 2,759,486 | 8/1956 | Pesaturo . | |
| 2,779,089 | 1/1957 | Allen . | |
| 3,210,836 | 10/1965 | Johanson et al. | 29/278 |
| 3,324,542 | 6/1967 | Hilti | 29/432 |

FOREIGN PATENT DOCUMENTS

| | | | |
|---|---|---|---|
| 1960086 | 6/1971 | German Democratic Rep. | 29/278 |
| 0282806 | 8/1952 | Switzerland | 227/147 |

*Primary Examiner*—Paul A. Bell
*Assistant Examiner*—Taylor J. Ross
*Attorney, Agent, or Firm*—Samuel M. Freund

[57] ABSTRACT

A wire setting tool for driving wire segments into hard or frozen surfaces. A vise assembly is slidably located in the bore of a hollow, elongated holder having a stabilizing handle rigidly but removably attached to one end at right angles to the bore. The jaws of the vise are operable by means of a screw threaded operating handle. A slot extending for a substantial distance along the longest dimension of the frame holder permits the vise operating handle to protrude from the holder. A second slot which extends the entire length of the longest dimension of the holder located approximately ninety degrees along the surface of the holder away from the operating handle slot and which is substantially parallel to this slot permits insertion of the wire segment into the vise jaws which are exposed by this longer slot. The tool is manually operable by grasping the stabilizing handle with one hand, placing the opposite end of the holder from which a small portion of the wire segment protrudes onto or near the surface to be implanted, and using the other hand to move the slidable vise operating handle sharply and forcefully in the direction of the surface after having first drawn the vise assembly and clamped wire segment back from this surface. By unscrewing the vise operating handle, the entire tool can be removed from the implanted wire segment.

11 Claims, 4 Drawing Figures

WIRE SETTING TOOL

BACKGROUND OF THE INVENTION

The present invention relates generally to driving tools and more particularly to a wire setting tool for driving wires into hard surfaces.

Among the uses of the tool of the present invention is driving standard surveyor's wire flags into hard or frozen earth. Currently, surveyor's flags are implanted in the ground by hand. This procedure is rarely successful if the ground is hard. That is, the flags are easily blown down by the wind. Alternate methods include driving a stake into the ground using a hammer, and wrapping the flag wire around it. This is a time-consuming and materials wasteful process. Manufacturers of surveyor's flags could also produce flags with much thicker wire staffs which could be pounded into the ground directly without bending, but this would again be costly in materials and would make such flags very heavy and bulky.

A patent search has uncovered two relevant references. U.S. Pat. No. 2,779,089 for "Puller Tool Having A Manually Operated Sliding Hammer," issued to Leo G. Allen on Jan. 29, 1957 teaches a pulling tool whereby a slidable hammer imparts motion to a clamp-like puller. In addition to being designed as a puller tool and not an insertion tool as is the present invention, Allen's patent teaches tool motion perpendicular to the clamping members as opposed to the substantially parallel motion of the vise of the instant invention to its constituent jaw members. U.S. Pat. No. 2,759,486 for "Umbrella Standard Device," issued to Arthur A. Pesaturo on Aug. 21, 1956 teaches the use of a slidable hammer similar to that described in the Allen patent for inserting an umbrella standard into the ground and for similarly removing it therefrom. The device requires two anvils attached to the standard, which anvils teach away from my invention since the wire lengths to be inserted into the ground are not required to have any appendages attached thereto in order for my tool to effectively operate thereon.

SUMMARY OF THE INVENTION

An object of my invention is to insert wire lengths into hard or frozen ground or other hard surfaces.

Another object of my invention is to drive surveyor's flags into hard or frozen ground.

Yet another object of the present invention is to insert artificial flowers with wire stems into wood or particle board bases or other hand surfaces.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the device of this invention includes an elongated holder having a bore along the entire length of its longest dimensions which opens into at least one end of the holder. A first slot is cut along the entire length of the longest dimension through the wall of the holder and into the bore for the purpose of inserting a wire length therein. A vise having two jaws is adapted to slide inside the bore. The jaws open facing the first slot and substantially parallel thereto so that the wire length can be received by the vise through this slot. Means are provided for causing the vise to clamp and release the received wire length. Means are also provided for driving the vise within the bore in either direction with a wire segment clamped in its jaws. This action will implant the wire into a surface located in the direction of travel of the vise when an open end of my tool is placed on or near such a surface.

Preferably, my tool is operable in cooperation with a first handle for stabilizing the holder when the tool is used for its intended purpose. This first handle is rigidly and removably located substantially near the end of the holder opposite to the end of the holder which is placed near to or against the surface into which the wire is to be driven. It is directed substantially perpendicularly to the holder bore. It is also preferred that the vise be driven by hand or by pneumatic means. Preferably, a second slot is provided, substantially parallel to the first slot and located along the longest dimension of the holder approximately ninety degrees from the first slot around the surface of the holder. This second slot does not extend the entire length of the holder and is fashioned to permit a second handle to have access to the side of the vise while being able to slide in the second slot. Preferably, the second handle simultaneously operates the vise jaws and is used to drive the vise in either direction when my tool is hand operated. The tool is designed to be used by either right or left handed persons. That is, it is preferred that the holder have an opening at each end in a symmetrical manner so that the first handle can be fastened to either of the ends of the holder and wire segments can be driven in either direction by right or left handed operators when the second handle is used to hand drive the vise and the first and second handles are directed oppositely or in a substantially perpendicular manner. Preferably also, the vise remains open and thereby in a fixed position when the second handle is removed for storage, the vise being prevented from falling out of the holder when not in use. It is finally preferred that the second handle and the length of the second slot determine the extent of travel of the vise when the tool is used for its intended purpose.

The tool of the present invention then provides a convenient and efficient method of inserting wire lengths into hard or frozen surfaces. In particular, the commonly observed blown down surveyor's flags should fade into distant memory, since such flags will be able to be inserted into the ground with speed and certainty.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
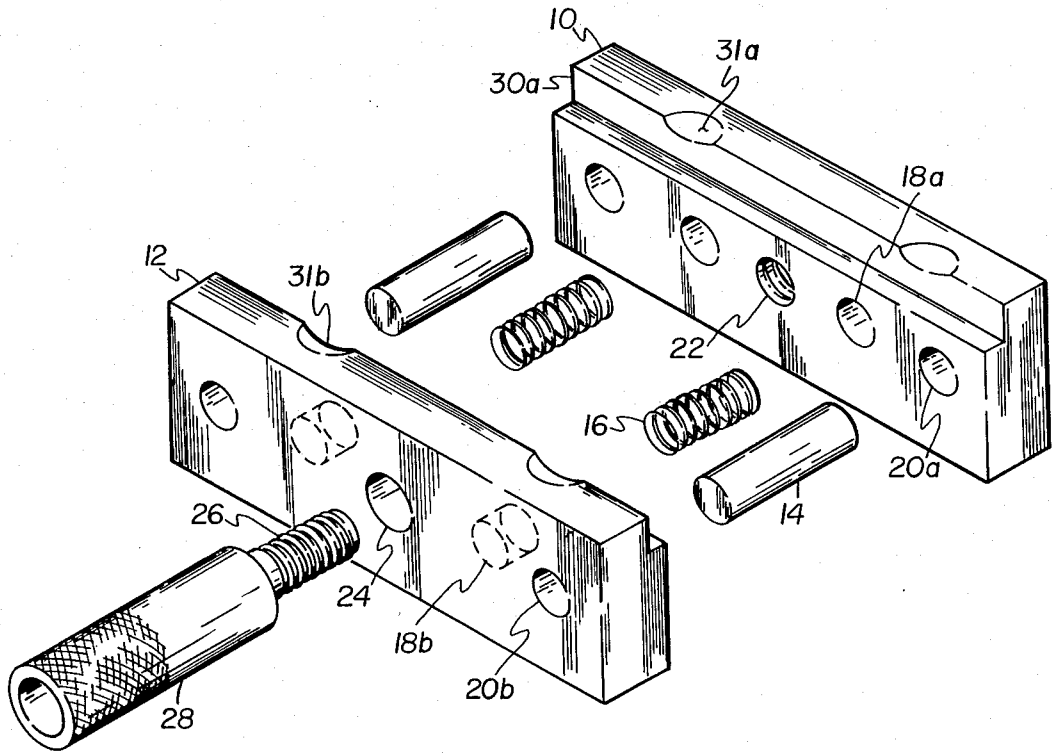
FIG. 1 shows a perspective view of the disassembled vise.

Reference will now be made in detail to the present preferred embodiment of the invention, an example of which is illustrated in the accompanying drawings. In the drawings, FIG. 1 shows a perspective view of the disassembled vise of the present invention. The vise includes a first 10 and a second 12 opposing jaw member, each of which has at least one blind clearance hole and an opposing blind clearance hole 18*a*, 18*b*, and at least one open clearance hole and an opposing open clearance hole 20*a*,20*b*. One cylindrical guide bar 14 fits into each of the open clearance hole pairs and is chosen to be of a length such that it does not protrude beyond the rear of the jaws when they are brought together. The guide bars provide a track for the jaws to travel on for smoother operation. One spring 16 fits into each of the blind hole pairs and tends to push the jaws apart. A handle 28 which is threaded at one end 26 is inserted through a clearance hole 24 in the second jaw 12 which is large enough to clear the threads 26, but too small to permit the handle stock to pass through, into a tapped hole 22 in the first jaw 10, the tapped hole being adapted to receive the threaded segment of the handle. The handle serves two functions. First, it opens and closes the jaws against the spring force in order to clamp wire segments in a rectangular relieved area 30*a*,30*b* which is provided to position and hold the inserted wire length approximately parallel to the direction of travel of the vise assembly. The handle further provides the operator of the tool a means for driving the vise forcefully in either direction in order to implant the wire into a chosen surface. Opposing indents 31*a*,31*b* are also provided to aid in the insertion of the wires.

Figure 2:
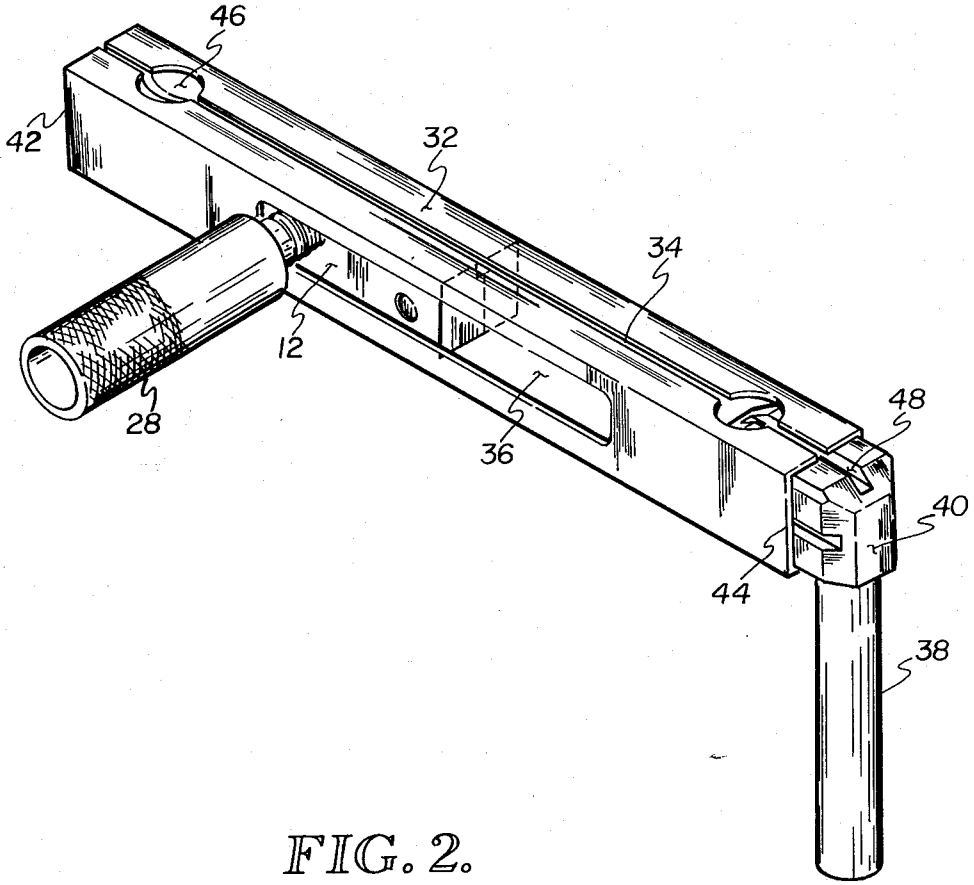
FIG. 2 shows a perspective view of the assembled tool of the present invention ready to accept a wire length and including the holder with both slots, the vise and both handles.

FIG. 2 shows a perspective view of the assembled tool. The vise assembly of FIG. 1 closely, but smoothly slidably (when closed), fits into the bore of an enclosed, rectangular channel holder 32. The second jaw 12 shows through a slot 36 in one face of the channel. The vise operating handle 28 is slidably located in this slot by reason of its attachment to the vise. A slot 34 which extends the entire length of the channel permits the insertion of wire segments into the vise. Enlargements 46 in this slot match indents 31*a*,31*b* in the vise jaws when the vise assembly is located at either end of the channel and facilitate the insertion of the wire segment. The travel of the vise is governed by the length of the slot 36 in which the operating handle 28 is located. When the operating handle 28 is unscrewed and removed from the vise assembly, the springs 16 push the jaws apart and against the channel bore walls thereby preventing the vise from falling out from either open end 42,44 of the channel. A stabilizing handle 38 can be located on either end of my tool depending on whether the tool operator is right or left handed since the tool is symmetrically constructed and the vise can be driven in either direction. Shown in FIG. 2 is one left hand tool operation configuration. Another left hand tool operation is attained by rotating the stabilizing handle 38 and adaptor 40 ninety degress so that the stabilizing handle 38 points in the opposite direction from the vise operating handle 28. The stabilizing handle 38 has an adaptor 40 located at one end to enable the handle to be inserted removably, but firmly, into either end of the channel. Slots 48 are cut into the adapter 40 to allow the wire segment to mvoe freely out of the end of the channel to which the stabilizing handle is attached.

Figure 3:
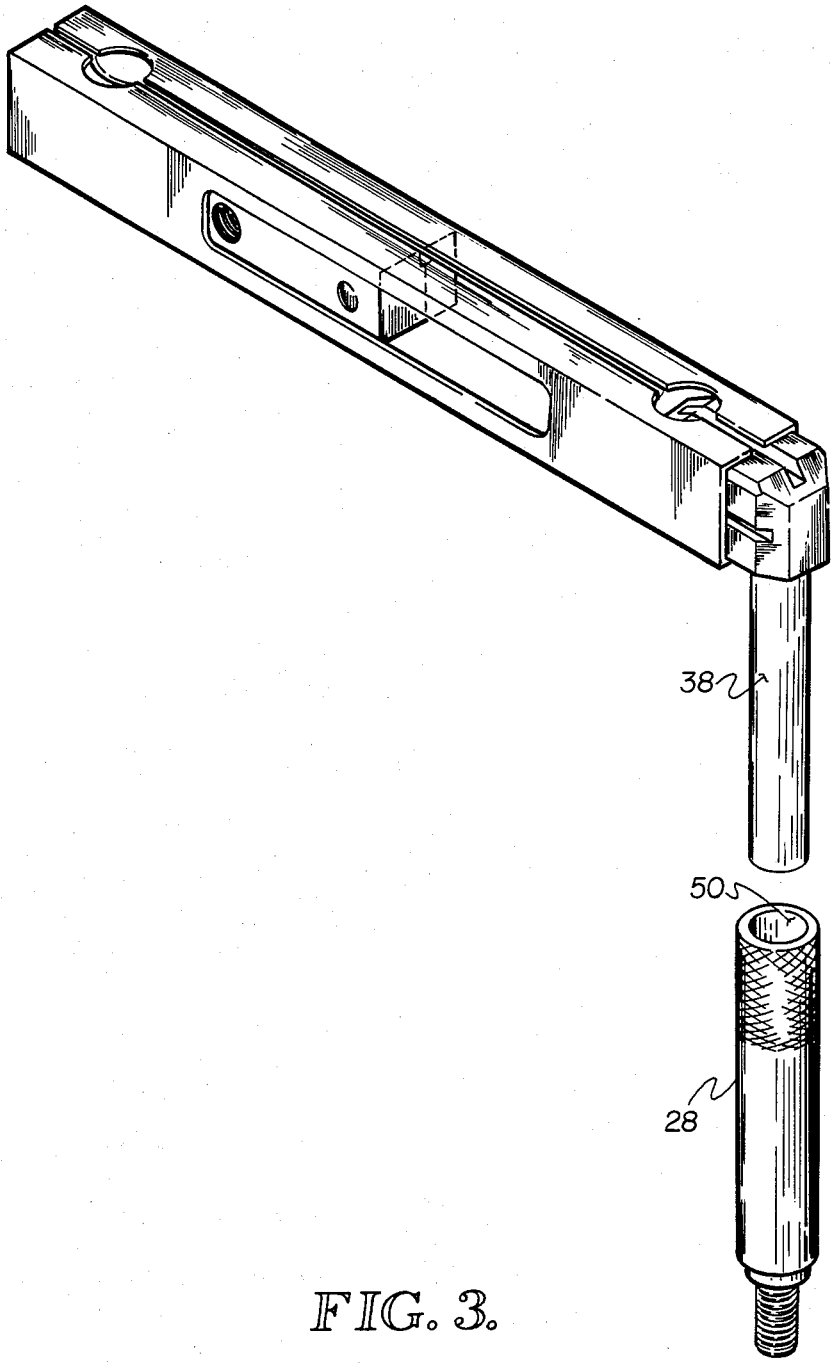
FIG. 3 shows the nesting characteristics of the two handles.
Figure 4:
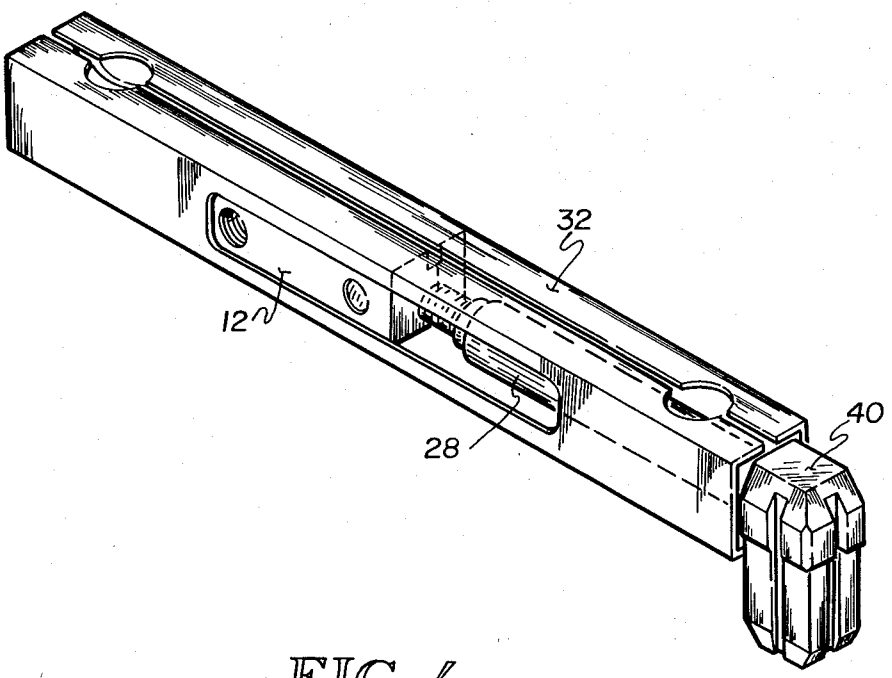
FIG. 4 shows a view of the tool when prepared for carrying or storage.

FIGS. 3 and 4 show the nesting characteristic of the two handles 28,38 which simplifies the storage and the carrying of my tool. The stabilizing handle 38 inserts into a hollow 50 in the operating handle 28 and the combination is inserted into the end of channel 32 opposite to that where the vise has been located.

In accordance with the invention, my tool is used by inserting a wire segment (standard surveyor's flags are typically about 0.093" dia. wire) through the long slot 34 into the jaws of the vise assembly which are exposed by this slot. The vise jaws are then closed by tightening the operating handle 28. The wire is allowed to protrude approximately 1" out of the end of the holder which will be placed in proximity to or in contact with the surface into which the wire segment is to be inserted when the vise is located closest to this end. Significantly more substantial extensions generally result in the bending of thin wires when the tool is operated against a hard surface such as hard or frozen soil. The stabilizing handle 38 has been attached or now may be attached to the opposite end of the holder from the protruding wire. This handle permits the operator to locate and hold the tool over the intended location while the slidable operating handle 28 is drawn back away from the end of the holder from which the wire segment end to be inserted protrudes thereby moving the vise and the clamped wire away from the surface of interest. A single, forceful motion of the operating handle in the direction of the surface implants the wire segment into the surface. This motion of the vise can also be achieved using spring or pneumatically actuated driving means as well as by hand operation. Once the wire is set, the vise jaws are opened by loosening the operating handle and my tool can be removed without disturbing the flag position. With this tool, then, wire segments can be inserted into hard materials in an efficient and certain manner thereby overcoming the difficulty of other methods which are either more labor and materials intensive or unreliable.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the holder and vise need not be rectangular, and the vise driving means may be pneumatic or spring actuated instead of the hand operation described hereinabove. The embodiment was choosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What I claim is:

1. A tool for driving a wire length into a hard material which comprises in combination:

a. an elongated holder having a bore therein, said bore extending the entire length of the longest dimension of said holder and opening into at least one end of said holder, said holder having a first slot which is coextensive with the entire length of said longest dimension and which penetrates from the outside of said holder through to said bore to permit the insertion of said wire length into said bore of said holder;

b. a vise adapted to be slidably located inside said holder and having a first jaw member and a second opposing jaw member, said jaw members opening along said first slot in order to receive said inserted wire length.

c. means for operating said vise to permit said received wire length to be clamped and released; and d. means for driving said vise forcefully along said bore while said received wire length is clamped by said vise thereby driving said wire length a chosen distance into said hard material after said clamped wire length and said vise are drawn back from said hard material.

2. The tool as described in claim 1, which further comprises a first handle for stabilizing said holder when said tool is used to drive said wire length into said hard material, said first handle being rigidly and demountably attached to the end of said holder located away from said hard material using first handle attaching means.

3. The tool as described in claim 2, wherein said holder has a second slot extending part way along said longest dimension of said holder substantially parallel to and spaced apart from said first slot, said second slot penetrating from the outside of said holder through to said bore, and wherein said vise operating means includes a second handle rotatably and demountably attached to said vise and adapted to slidably extend out of said second slot in a substantially perpendicular manner to said bore whereby said second handle travels along with said vise.

4. The tool as described in claim 3, wherein said holder includes a rectangular channel having four sides and at least one rectangular open end, wherein said vise includes rectangular jaw members, wherein said first slot is located in a first side of said channel at approximately its center, and wherein said second slot is located at the approximate midpoint of a second, adjacent side of said channel, said second side being substantially perpendicular to said first side.

5. The tool as described in claim 4, wherein said second handle further comprises a stock and a cylindrical threaded segment rigidly and non-rotatably attached to said stock.

6. The tool as described in claim 5, wherein said first jaw member has a tapped hole therein adapted to receive said threaded end of said second handle, wherein said second jaw member has a clearance hole therein through which said cylindrical threaded segment of said second handle can freely pass, said clearance hole and said tapped hole having colinear axes when said first jaw member and said second jaw member lie in opposition comprising said vise, wherein said clearance hole is smaller than said stock, wherein said cylindrical threaded segment is of a length such that said second handle can tighten and release the grip of said vise, and wherein the opening of said first jaw member and said second jaw member is located within said bore adjacent to said first slot.

7. The tool as described in claim 6, wherein said first jaw member and said second jaw member have at least one opposing clearance hole pair therein, and wherein said vise further comprises at least one jaw guide member adapted to be slidably located in said opposing clearance hole pairs, one of said jaw guide members for each of said opposing hole pairs, said jaw guide member further being adapted to slidably fit inside of said bore substantially perpendicular thereto, whereby said jaw members are caused to travel along said guide members when tightened and released by said second handle.

8. The tool as described in claim 7, wherein said first jaw member and second jaw member have at least one blind opposing clearance hole pair, and wherein said vise further comprises at least one spring member adapted to be slidably located in said blind opposing clearance hole pairs, one of said spring members for each of said blind opposing hole pairs, said spring member being further adapted to force said jaw members apart against the holding action of said second handle stock and said second handle cylindrical threaded segment applied to said first jaw member and said second jaw member.

9. The tool as described in claim 8, wherein said vise driving means includes said second handle which permits said vise to be forcefully driven in either direction with said bore by hand.

10. The tool as described in claim 9, wherein said first handle fits into said second handle and said second handle can be inserted into said bore in such a way that said tool is made compact for carrying purposes.

11. The tool as described in claim 10, wherein said first handle attaching means is adapted to permit said inserted wire length to pass freely by said first handle attaching means when said tool is operated.

* * * * *